United States Patent [19]

Davidson et al.

[11] Patent Number: 4,665,572

[45] Date of Patent: May 19, 1987

[54] SWIMMING POOL THERAPY APPARATUS

[76] Inventors: Peter Davidson, 27308 Pacific Coast Hwy., Malibu, Calif. 90265; Gretchen Buck, 8242 W. Third St., Los Angeles, Calif. 90048

[21] Appl. No.: 924,824

[22] Filed: Oct. 30, 1986

Related U.S. Application Data

[63] Continuation of Ser. No. 793,747, Nov. 1, 1985.

[51] Int. Cl.[4] ..... E04H 3/18; A61H 33/02; E03C 1/02

[52] U.S. Cl. ..... 4/492; 4/496; 4/541; 4/542; 4/491; 128/66

[58] Field of Search ..... 4/492, 491, 488, 541, 4/542, 543; 128/66

[56] References Cited

U.S. PATENT DOCUMENTS

| | | | |
|---|---|---|---|
| 2,662,553 | 12/1953 | Dimmock | 138/37 |
| 2,733,711 | 2/1956 | Gibson | 128/66 |
| 3,185,181 | 5/1965 | Demyan | 138/37 |
| 3,292,615 | 12/1966 | Bascomb et al. | 128/66 |
| 4,352,215 | 10/1982 | Laing | 4/492 |
| 4,561,133 | 12/1985 | Laing | 4/492 |

FOREIGN PATENT DOCUMENTS 2222594 11/1973 Fed. Rep. of Germany ..... 4/191

*Primary Examiner*—Henry K. Artis
*Attorney, Agent, or Firm*—Donald A. Kaul

[57] ABSTRACT

A therapy apparatus to be mounted in a pool of water for generating a laminar flow of water at a rate sufficient for exercising and therapy purposes. A housing is secured externally to a swimming pool, the water inlet and outlet being disposed within the pool of water and being supported by the external housing. The water inlet is located below the surface of the swimming pool, water being forced through the inlet and upwardly by a rotating impeller to the outlet. The water outlet is below the water surface and directs the flow of water substantially parallel to the surface of the swimming pool and at an angle of approximately 90 degrees of arc with respect to the flow at the impeller. Sets of radial, elbow and outlet diffusers are mounted within the water flow chamber to create a laminar flow of water at the output and substantially eliminate all unwanted turbulance.

10 Claims, 4 Drawing Figures

SWIMMING POOL THERAPY APPARATUS PRIOR APPLICATION

This application is a continuation of application serial No. 06/793,747 filed Nov. 1, 1985.

BACKGROUND OF THE INVENTION

1. Field of the Invention

The present invention generally relates to fluid moving apparatus and more particularly to devices for generating currents of water in swimming pools to be used for therapy or recreational purposes 2. Prior Art A number of devices are disclosed in the prior art which are used for generating currents of water in swimming pools. The typical device is permanently affixed to the swimming pool during construction. In this class of devices, an inlet is provided through the shell of the pool and an appropriate pump or other means is used to drive the water from an outlet through the shell of the pool. The inherent problems in this type of device are evident. Since the device is intended to be mounted through the permanent shall of the pool, it is usable only where it can be installed during fabrication. The present invention totally eliminates this problem since the housing is mounted external to the pool with the water inlet and flow outlet being supported from the externally mounted housing.

German Design Patent No. 1,964,441 provides in a swimming pool a nozzle directed into the water for the purpose of generating a water current. The nozzle is connected to the pressure nipple of a pump disposed outside the pool whereby the suction nipple of the pump is connected with an outlet opening of the swimming pool. In these types of devices, the inherent disadvantages arise from the need to have water tight attachments for pumping the water from the pool and back to the pool through the nozzle. The present invention solves this problem by driving an impeller which is located in the pool from an external power source. Water never leaves the pool and merely passes into the inlet, past the impeller and is then redirected parallel to the surface of the swimming pool.

A third type of device disclosed by the prior art attempts to control the quality of the current flow in the pool. In these devices, a rotatable propeller draws water from the pool and forces it through an output channel. Guiding elements are located at the output to control the direction of the water flow. The problems which exist in this type of device relate to the inability to create a laminar water flow. Merely changing the direction of the water does not eliminate the turbulance which is associated with the movement of fluids at high rates. The inter-relationship between the water and the conduit through which it is being moved and the effect of the guide elements themselves totally negate any ability to produce a non-turbulant flow of water. The present invention substantially resolves this problem by employing consecutive sets of diffusing devices which will produce a laminar flow of water typically at a rate of approximately 2,500 gallons per minute. By producing the laminar flow of water, the flow is non-turbulant thereby improving the ability to employ the device for therapy and recreational purposes.

SUMMARY OF THE INVENTION

The present invention comprises a device for producing a laminar flow of water in a swimming pool to be used for recreation or therapy. A housing is mounted on the deck adjacent a swimming pool, the housing employing a source of rotary power which is transferred to an end of an axle, the other end thereof being disposed within the swimming pool. Ingress for the source of water is disposed approximately 48 inches below the water surface of the swimming pool, an impeller being rotated by the axle causing the input water to proceed upwardly past the impeller through the enclosing conduit. Downstream from the impeller the conduit undergoes a 90 degree change of direction to output water substantially at the surface of the swimming pool. A radial diffuser assembly is axially mounted within the conduit adjacent to and downstream from the impeller. The radial diffuser assembly prevents cavitation which would otherwise result from rotation of the impeller and starts the laminarization of the water flowing through the conduit. A set of elbow diffusers are radially disposed within the conduit downstream from the radial diffuser assembly at the location where the conduit changes direction by 90 degrees, the diffusers being uniformly spaced across the elbow of the conduit. As the water moves past the second set of diffusers, the remaining turbulant flow of water through the main conduit is broken into a second stage of laminar flow by passing over and under the uniform, radially contoured diffusers. A third set of outlet diffusers are uniformly spaced across the water outlet in substantial alignment with the laminar flow. By preventing the water flow from engaging any oblique surfaces, the output of the present invention comprises a laminar flow of water which is substantially devoid of turbulance.

It is therefore an object of the present invention to provide an apparatus for producing a laminar flow of water in a swimming pool.

It is another object of the present invention to provide a current generating apparatus for a swimming pool which includes an externally mounted power source.

It is yet another object of the present invention to provide an apparatus for producing a water current in a swimming pool which is non-turbulent and laminar.

It is still yet another object of the present invention to provide an improved apparatus for producing a current in a swimming pool which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

DESCRIPTION OF THE PRESENTLY PREFERRED EMBODIMENT

Figure 1:
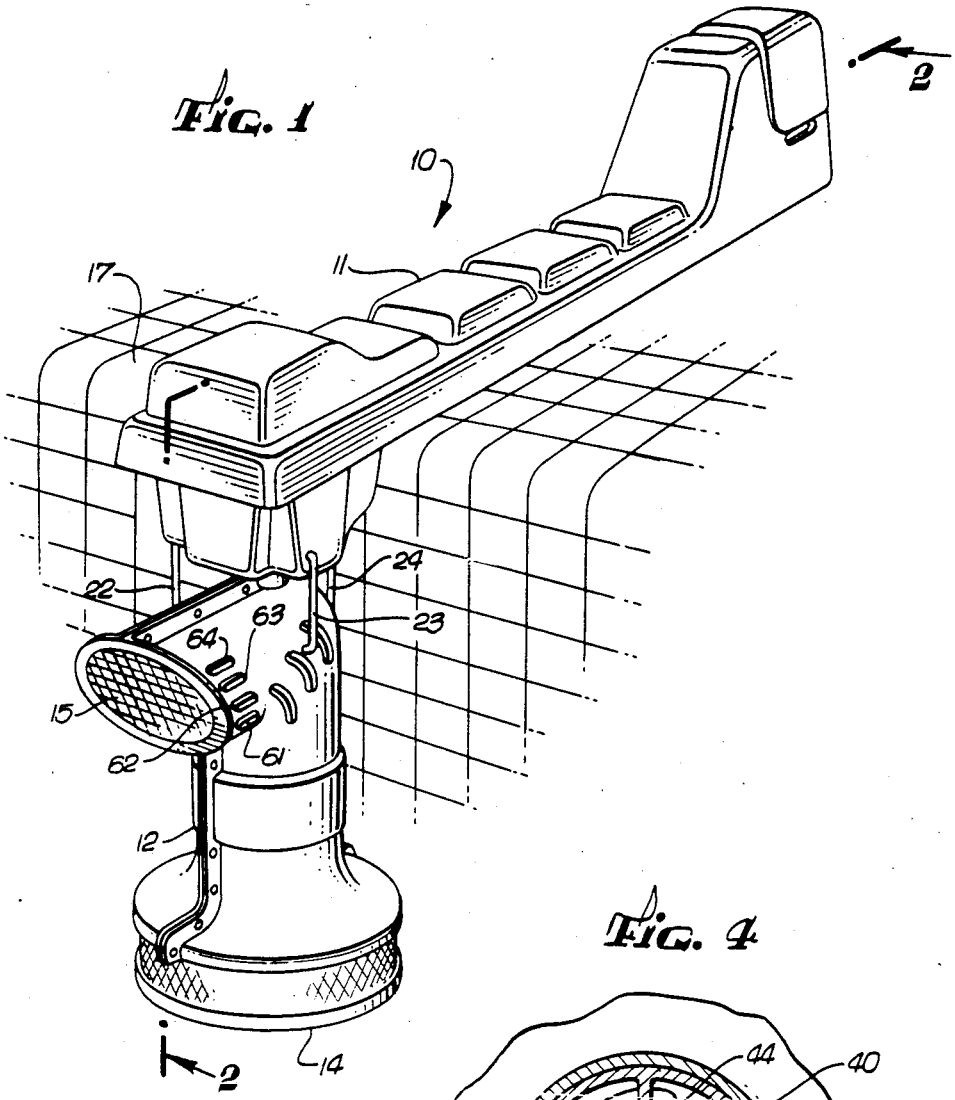
FIG. 1 is a perspective view of the present invention in location on the deck of a swimming pool.
Figures 2, 3:
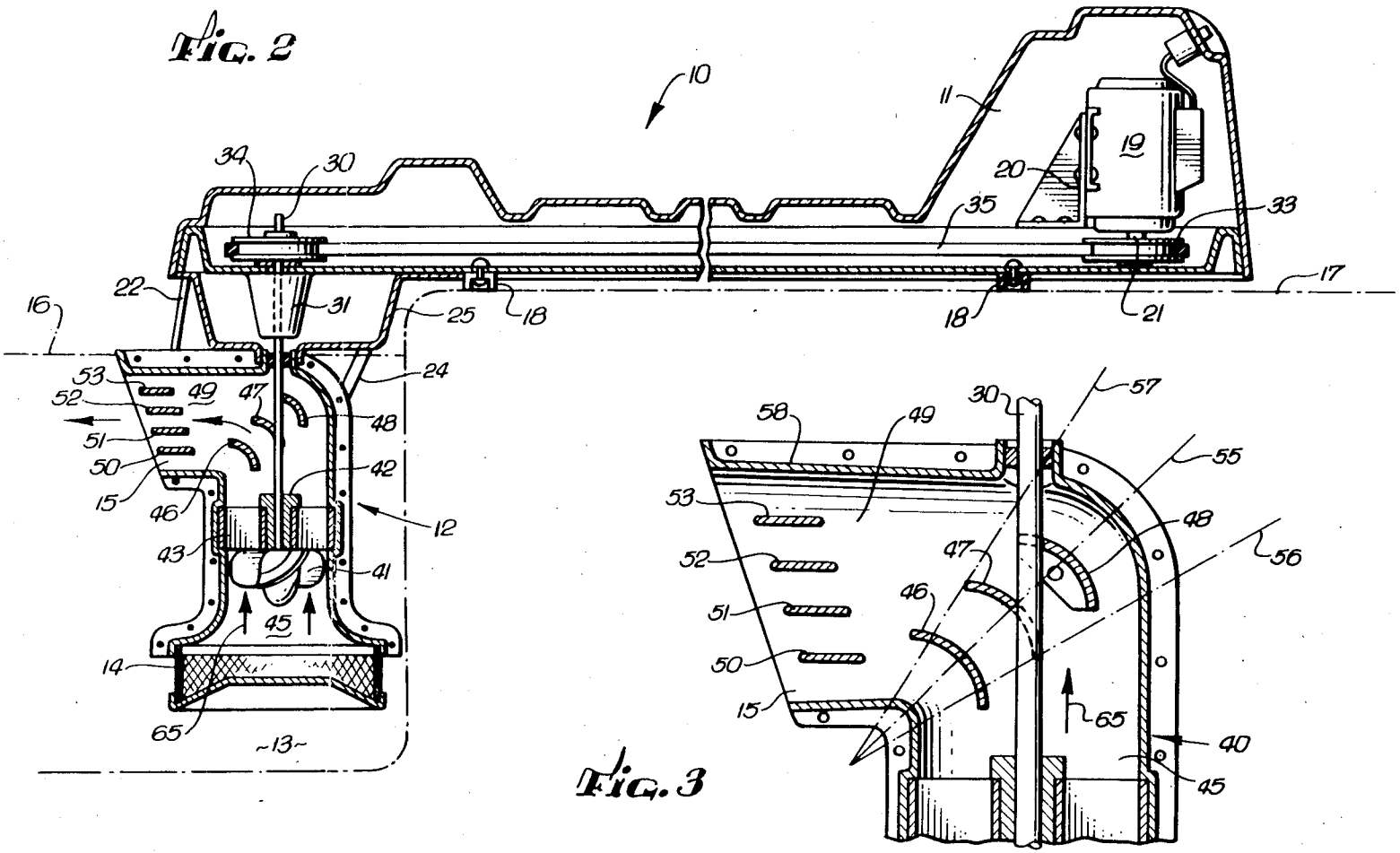
FIG. 2 is a cross-sectional view of the present invention taken through line 2—2 of FIG. 1.
FIG. 3 is an enlargewd cross-sectional view of the main conduit illustrating the elbow and outlet diffusers.

An understanding of the present invention can be best gained by reference to FIGS. 1 and 2 wherein the present invention is shown mounted adjacent a swimming pool, the present invention apparatus for producing a controlled current flow in a swimming poool being generally designated by the reference numeral 10. The current flow apparatus 10 comprises a power module 11 which is preferably mounted external to the swimming pool and a current flow unit or flow generating means 12 which is coupled to the power unit and is disposed within swimming pool 13. It is understood that a power module could be mounted through swimming pool wall in a conventional manner. The water inlet 14 and the water outlet 15 are placed below the water line 16 of swimming pool 13.

Power unit 11 is adapted to be mounted upon deck 17 adjacent swimming pool 13 on conventional mounting pads 18. A source 19 of rotary power is secured to motor mount 20. Power source 19 is a drive motor means in the form of a conventional electric motor which produces a power output at axle 21 of approximately 2–3 horsepower.

The current flow unit 12 is mounted beneath an end of power unit 11 from mounting straps 22, 23, and 24. Since it is an object of the present invention to provide for the laminar flow of water in a swimming pool, mounting straps 22, 23 and 24 allow for any minor adjustments in orientation which are required. In order to fully support the weight of current flow unit 12, housing 25 is braced against the wall of swimming pool 13 at mounting pad 26. Axle 30 is journeled within subhousing 31 within appropriate bearings, axle 30 being parallel to output axle 21. Pully wheels 33 and 34 are mounted on axles 21 and 30, respectively, pully wheels 33 and 34 being aligned with each other. A conventional pully belt 35 is disposed about pully wheels 33 and 34 to link the power output of motor 19 to axle 30. Although the use of pully wheels 33 and 34 and transfer pully belt 35 are preferred, it is understood that other conventional power transfer methods could be employed.

Axle 30 extends through the upper wall of conduit 40 of current flow unit 12. Impeller 41 is secured at the lower end of axle 30. Axle 30 is appropriately journeled in thrust block 42 which is axially coupled within radial diffuser assembly 43. It is therefore clear that the rotation of output axle is transferred to axle 30 through pully belt 35 and the associated pully wheels 33 and 34 with the subsequent rotation of impeller 41 within the confines of conduit 40.

As stated hereinabove, the primry objective of the present invention is to provide current in a swimming pool for recreational and therapy purposes. The current produced by the rotation of impeller 41 will typcially produce a flow rate of approximately 2,500 gallons per minute. Water is input at water inlet 14 and drawn through conduit 40 by the rotation of impeller 41. The ability to produce a laminar flow of water at rates approximating 2,500 gallons per minute is accomplished through the use of three sets of diffusing elements which are mounted within conduit 40.

As can be seen in FIG. 2, conduit 40 includes a lower section having a lower chamber 45 which is substantially cylindrical and in axial alignment with axle 30. Water inlet 14 is a cylinder axially aligned with axle 30. Conduit 40 uniformly flairs outwardly to interface to inlet 14 giving the lower end of lower chamber 45 a uniformly decreasing diameter with respect to the flow of water. Impeller 41 rotates within lower chamber 45 drawing water upwardly to engage three separate stages of flow diffusing means, as will be hereinafter described. The first stage is constituted by a radial assembly 43 and the second stage is constituted by a set of elbow diffusers 46, 47 and 48. The upper chamber 49 of conduit 40 is substantially at a right angle with respect to axle 30 and the axially aligned lower chamber 45. As will be described in more detail hereinbelow, elbow diffusers 46, 47 and 48 are located along a line bisecting the 90 degree angle between upper chamber 49 and lower chamber 45. Water outlet 15 is at the terminus of upper chamber 49. The upper stage is constituted by four outlet diffusers 50, 51, 52 and 53 which are mounted across the opening of outlet 15 to further the laminar flow of liquid and thereby complete the process of substantially eliminating the turbulant output of water which would otherwise occur.

Figure 4:
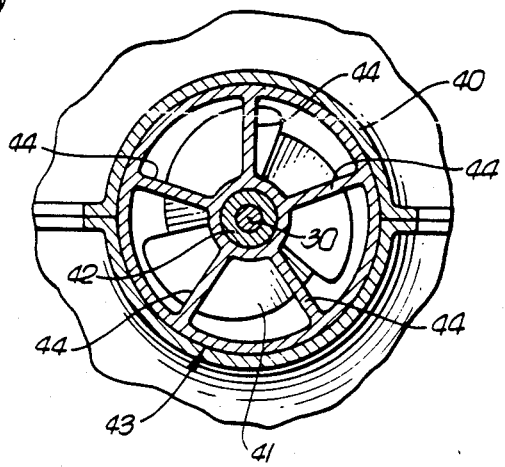
FIG. 4 is a cross-sectional view of the radial diffuser assembly taken through line 4—4 of FIG. 2.

Radial assembly diffuser assembly 43 is axially mounted within conduit 40 immediately adjacent to and downstream from impeller 41, and thus within an intermediate section of the flow generating means 12. As can be best seen in FIG. 4, thrust block 42 is mounted along the longitudinal axis of radial diffuser assembly 43, axle 30 being journeled in thrust block 42. Radial diffuser assembly 43 comprises a plurality of diffusing vanes 44, each being radially mounted with respect to the axis of radial diffuser assembly 43. The rotation of a propeller through a liquid will, unless inhibited, produce unwanted cavitation effects. In the present invention, as water is forced upwardly through conduit 40 by impeller 41, diffusing vanes 44 will inhibit cavitation and initialize the laminarization of the water flow.

An understanding of the construction of elbow diffusers 46, 47 and 48 and output diffusers 50, 51, 52 and 53 can be best gained by reference to FIG. 3 wherein an enlarged cross sectional view of the top portion of the intermediate section, as well as an upper section containing chamber 49 can be best seen. As stated, the axis of upper chamber 49 is at approximately a right angle to the axis of lower chamber 45. A line bisecting the intersection of upper chamber 49 and lower chamber 45 is designated by the reference numeral 55. Since laminar flow is a primary goal of the present invention, the placement of elbow diffusers 46–48 attempt to eliminate all oblique surfaces which would otherwise cause turbulance. As seen in FIG. 3, the curvature in conduit 40 can be represented by the 90 degree arc intermediate the section lines 56 and 57. Below section line 56, the walls of conduit 40 define a cylindrical volume. In a like manner, beyond section line 57, the walls of conduit 40, and upper chamber 49 define a uniform volume.

The second step in creating a laminar flow of water is the configuration and placement of elbow diffusers 46, 47 and 48. As can be seen from FIG. 1, elbow diffusers 46, 47 and 48 are mounted across the interior of conduit 40 and are secured within receiving sections 58, 59 and 60, respectively. The angular arc of elbow diffuser 47 is defined by section lines 56 and 57. The angular arc of elbow diffuser 46 is greater than that defined by section line 56 and 57. The angular arc of elbow diffuser 48 is less than that defined by section lines 56 and 57. In each case, the radius of the respective elbow diffuser is centered on bisecting line 56 and is determined by the location of the tangeants to the respective curve at the location where the arcs intersect section lines 56 and 57. In each case, a tangeant drawn at the ends of elbow diffusers 46, 47 and 48 would be parallel to the respective axes of lower chamber 45 and upper chamber 49.

The outlet diffusers 50, 51, 52 and 53 are spaced uniformly across outlet 15 and further define the laminar flow initiated by elbow diffusers 46, 47 and 48. As shown in FIG. 3, the outer wall 58 flares outwardly to outlet 15, the deflection being approximately 6 degrees of arc with respect to the axis 59 of upper chamber 49. As can be seen in FIG. 1, in a manner similar to the elbow diffusers, outlet diffusers 50, 51, 52 and 53 are secured in mountings 61, 62, 63 and 64, respectively, disposed in the walls of upper chamber 49 of conduit 40.

In operation, upon the actuation of power source 19, impeller 41 draws water through inlet 14 and upwardly in the direction represented by reference numeral 65 (FIGS. 2 and 3). Water being moved at a rate of approximately 2,500 gallons per minute interfaces with radial diffusing vanes 44 and elbow diffusers 46, 47 and 48 and completes the first and second stages of laminarization. Since no oblique surfaces are encountered, the 90 degree change of direction causes no turbulance. The third stage of laminarization occurs when the current of water passes outlet diffusers 50–53, inclusive. The expanding volume of upper chamber 49 results in a reduction in the rate of water flow from elbow diffusers 46, 47 and 48 to outlet 15. The reduction in flow rate further enhances laminarization. The current of water forced into the swimming pool can be at a rate as high as 7,500 gallons per minute and is absent the turbulance generally associated with other current generating devices.

While the foregoing detailed description relates to a preferred embodiment of the present invention, it will be understood that various changes and modifications apparent to those of ordinary skill in the art may be made without departing from the spirit and scope of the invention as defined in the appended claims.

What is claimed is:

1. Apparatus for generating a laminar flow in a reservoir containing water, said apparatus comprising:

drive motor means disposed outside said reservoir;

flow generating means disposed within said reservoir and submerged in the water therein;

said flow generating means including an upper section nearest the surface of the water, a lower section submerged the farthest beneath the surface of the water, and an intermediate section between said upper and lower sections;

said lower section having a water inlet therein to permit water to be drawn into said flow directing means and said upper section having a water outlet therein to permit water to be discharged from said flow directing means in a laminar flow pattern;

impeller means disposed within said flow generating means above said water inlet;

said flow generating means including three separate stages of flow diffusing means disposed between said impeller means and said water outlet, defining a first, second and third stage;

each of said separate stages of flow diffusing means including a plurality of spaced vane members across which water passes as it traverses through said flow generating means from said water inlet to said water outlet; and means operatively connecting said impeller means to said drive motor means whereby operation of said drive motor means rotates said impeller means and thereby draws water from said reservoir into said water inlet;

said operation of said impeller means further causing the water drawn in through said water inlet to pass across said three separate stages of flow diffusing means, which serve to laminarize the flow characteristics of the water, and then to discharge through said water outlet as non-turbulent laminar flow.

2. Apparatus as defined in claim 1 wherein said first stage of flow diffusing means is disposed within said intermediate section above said impeller means to counteract cavitational effects caused by operation of said impeller means and to initialize the laminarization of water flow through said flow generating means.

3. Apparatus as defined in claim 2 wherein said second stage of said flow diffusing means is located substantially at the intersection of said intermediate and upper sections.

4. Apparatus as defined in claim 3 wherein said third stage of said flow diffusing means is disposed in said upper section adjacent the water outlet.

5. Apparatus as defined in claim 3 wherein the vane members forming said second stage consist of a plurality of spaced arcuately curved members.

6. Apparatus as defined in claim 4 wherein the vane members forming said third stage consist of a plurality of spaced vane members disposed in substantially parallel relation to the surface of the water in said reservoir.

7. Apparatus as defined in claim 1 wherein said upper section expands in size as it extends from its intersection with said intermediate section to the water outlet to cause a reduction in the rate of water flow between said second and third stages.

8. Apparatus as defined in claim 1 wherein the end of said upper section forming said water outlet slopes angularly downward from the surface of the water in said reservoir.

9. Apparatus as defined in claim 1 wherein said means operatively connecting said impeller means to said drive motor means includes a substantially vertically extending shaft projecting upwardly through said flow generating means and above the surface of the water in said reservoir.

10. Apparatus as defined in claim 9 wherein said means operatively connecting said impeller means to said drive motor means further includes a substantially horizontal drive belt mechanism operatively connected between said drive motor means and said shaft.

* * * * *